US007778573B2

(12) United States Patent
Yamashita et al.

(10) Patent No.: US 7,778,573 B2
(45) Date of Patent: Aug. 17, 2010

(54) IMAGE FORMING APPARATUS AND PROCESS CARTRIDGE

(75) Inventors: Takeshi Yamashita, Osaka (JP); Takafumi Miyazaki, Osaka (JP); Tomoya Adachi, Osaka (JP); Yoshie Tsuchida, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 296 days.

(21) Appl. No.: 11/962,800

(22) Filed: Dec. 21, 2007

(65) Prior Publication Data

US 2008/0152378 A1 Jun. 26, 2008

(30) Foreign Application Priority Data

Dec. 26, 2006 (JP) ..... 2006-350673
Feb. 13, 2007 (JP) ..... 2007-031448

(51) Int. Cl.
*G03G 15/16* (2006.01)

(52) U.S. Cl. ..... 399/129; 399/101; 399/111; 399/302; 399/350; 399/353; 399/357; 399/358

(58) Field of Classification Search ..... 399/101, 399/354, 129, 357, 358, 302, 308, 111, 350, 399/353

See application file for complete search history.

(56) References Cited

U.S. PATENT DOCUMENTS 6,975,823 B2 * 12/2005 Onishi et al. ..... 399/128
2005/0074265 A1 * 4/2005 Furukawa ..... 399/357

FOREIGN PATENT DOCUMENTS

| | | | |
|---|---|---|---|
| JP | 05061383 | A * | 3/1993 |
| JP | 2665408 | B2 | 6/1997 |
| JP | 3248047 | B2 | 11/2001 |
| JP | 2003-66696 | | 3/2003 |
| JP | 2003-186364 | | 7/2003 |
| JP | 2004-264521 | | 9/2004 |
| JP | 2005-316371 | | 11/2005 |

OTHER PUBLICATIONS

U.S. Appl. No. 12/171,613, filed Jul. 11, 2008, Adachi, et al.

* cited by examiner

*Primary Examiner*—Constantine Hannaher
(74) *Attorney, Agent, or Firm*—Oblon, Spivak, McClelland, Maier & Neustadt, L.L.P.

(57) ABSTRACT

An image forming apparatus includes an image carrier, a toner image forming unit configured to form a toner image having a predetermined polarity on the image carrier, an intermediate transfer body facing the image carrier, a primary transfer member configured to transfer the toner image on the image carrier onto the intermediate transfer body, a secondary transfer member configured to transfer the toner image on the intermediate transfer body onto a recording medium, and a contacting member in contact with the image carrier and configured to remove residual toner remaining on the image carrier after the toner image is transferred by the primary transfer member onto the intermediate transfer body and to pass the removed residual toner to the intermediate transfer body. A bias voltage with the same polarity as the predetermined polarity of the toner image is applied to the contacting member.

20 Claims, 9 Drawing Sheets

IMAGE FORMING APPARATUS AND PROCESS CARTRIDGE

BACKGROUND OF THE INVENTION

1. Field of the Invention

The present invention generally relates to an image forming apparatus such as a copier, a printer, or a facsimile machine using an electrophotographic process, and a process cartridge used in the image forming apparatus.

2. Description of the Related Art

In these days, miniaturization, high image quality, and ecology are key factors in developing image forming apparatuses. A "cleaner-less" image forming apparatus is one solution for reducing the size of an image forming apparatus. In a cleaner-less image forming apparatus, a developing unit functions also as a cleaning unit for removing toner remaining on a photoconductor after transferring a toner image, and thus a dedicated cleaning device is omitted.

For example, patent document 1 discloses a cleaner-less image forming apparatus including a developing unit that forms a toner image by developing a latent image formed on a uniformly-charged image carrier with a developer including spherical toner particles and carrier particles and held on a developer carrier. The developing unit contains yellow toner, cyan toner, magenta toner, or black toner, and also functions as a cleaning unit that reclaims toner remaining on the image carrier after transferring a toner image onto a recording medium (hereafter such remaining toner may be called post-transfer residual toner) and while developing another toner image. The developing/cleaning unit constitutes an image forming unit, and multiple image forming units are disposed along a conveyor belt in the disclosed cleaner-less image forming apparatus. A recording medium is conveyed by the conveyor belt through the image forming units to form a color image. In the disclosed cleaner-less image forming apparatus, an area of a spherical toner particle covered by a sizing agent is limited to 15% to 50% of the entire surface area, the shape factor SF-1 of the spherical toner particles is between 100 and 140, and the shape factor SF-2 is between 100 and 120.

In a color image forming apparatus including multiple image forming units as described above, toner images of different colors are formed by the image forming units, transferred to and superposed on an intermediate transfer body in sequence by a primary transfer member, and then transferred together onto a recording medium by a secondary transfer member. One problem in employing a cleaner-less configuration in such a color image forming apparatus is that if toner on the intermediate transfer body (or an image receiving body) is transferred back onto a photoconductive drum (hereafter such toner may be called reverse-transferred toner) and enters a developing unit, toners of different colors are mixed in the developing unit and cause a color shift.

Patent document 2 discloses an image forming apparatus that tries to solve this problem. The disclosed image forming apparatus includes a photoconductor on which a toner image is formed, and an intermediate transfer body onto which the toner image is transferred from the photoconductor. The toner image on the intermediate transfer body is transferred and fused to a recording medium to form an image on the recording medium. The disclosed image forming apparatus also includes a cleaning device comprising a scraper for scraping post-transfer residual toner on the photoconductor and a housing containing the scraper and having an opening toward the surface of the intermediate transfer body.

In the image forming apparatus disclosed in patent document 2, the cleaning device prevents mixing of toners of different colors and prevents a charging unit from being tainted. However, providing a cleaning device with such a housing increases the size and costs of an image forming apparatus.

Patent document 3 discloses a contact charging method used in an electrophotographic device. In the disclosed method, a bias with a polarity opposite to the charge polarity of a photoconductor is applied to at least one of multiple charging units, a bias of the same polarity as the charge polarity of the photoconductor is applied to at least one of the remaining charging units, and the photoconductor is charged to a predetermined potential by the charging units. With this method, however, since a photoconductor is charged by multiple charging units, the photoconductor is exposed to electrostatic hazards at two or more positions. As a result, the influence of corona products on the photoconductor increases, and the electrostatic characteristics of the photoconductor are gradually degraded as it is charged and discharged repeatedly. With the disclosed contact charging method, this problem becomes especially prominent because a photoconductor is first charged to a polarity opposite to a desired charge polarity and then charged to the desired charge polarity.

Meanwhile, in a color laser printer, toner images of different colors are formed on a photoconductive drum or an image carrier using toners or developers of corresponding colors, and the toner images are electrically transferred to and superposed on an image receiving body such as a recording medium or an intermediate transfer belt to form a multi-color toner image.

Also, in some color laser printers, a photoconductive drum is provided for each of multiple colors. Such color laser printers are called tandem color laser printers.

In a color-image forming process, when a toner image of one color is transferred onto an image receiving body on which a toner image of another color is already present, the charge amount of the already present toner image increases. Increase in the charge amount increases the chance of the toner of the already present toner image to be reverse-transferred onto the photoconductive drum from the image receiving body. When toner is reverse-transferred from an image receiving body onto a photoconductive drum and sticks to a charging roller or enters a developing unit, it causes problems such as potential irregularities and degrades image quality. To prevent such problems, conventional color laser printers include a cleaning device for reclaiming residual toner on a photoconductive drum.

Meanwhile, as described above, a "cleaner-less" method or configuration (see, for example, patent document 1) makes it possible to reduce the size of an image forming apparatus, to reduce waste toner, and to reduce toner consumption per page.

The "cleaner-less" method or configuration is also applicable to a color image forming apparatus using an intermediate transfer body.

In a color image forming apparatus, toner images of different colors are formed by multiple image forming units, transferred to and superposed on an intermediate transfer body in sequence, and then transferred together onto a recording medium by a secondary transfer member. One problem in employing a cleaner-less configuration in such a color image forming apparatus is that if toner on the intermediate transfer body (or an image receiving body) is transferred back onto a photoconductive drum and enters a developing unit, toners of different colors are mixed in the developing unit and cause a color shift.

Patent document 4 tries to solve the above problem. An image forming apparatus disclosed in patent document 4 is configured to measure the amount of reverse-transferred toner on a developing roller based on the operating time of the image forming apparatus, the areas of images formed, and the charge amount of a developer. When the measured amount of reverse-transferred toner reaches a predetermined limit, the disclosed image forming apparatus removes reverse-transferred toner on the developing roller either by forming a solid image on a photoconductive drum and transferring the solid image onto a recording medium, a conveyor belt, or an intermediate transfer belt; or by separating the photoconductive drum and the developing roller and then rotating the developing roller alone.

However, it is generally difficult to correctly measure the amount of reverse-transferred toner since it is influenced by the aging of toner. Also, in a cleaner-less image forming apparatus where a developing unit reclaims residual toner on a photoconductive drum after transferring a toner image and while developing another toner image, if toner from an upstream developing unit is mixed with toner in a downstream developing unit, it causes a color shift in the downstream developing unit.

[Patent document 1] Japanese Patent No. 3248047

[Patent document 2] Japanese Patent Application Publication No. 2003-186364

[Patent document 3] Japanese Patent Application Publication No. 4-310980

[Patent document 4] Japanese Patent Application Publication No. 2005-316371

SUMMARY OF THE INVENTION

Embodiments of the present invention provide an image forming apparatus and a process cartridge used in the image forming apparatus that solve or reduce one or more problems caused by the limitations and disadvantages of the related art.

An embodiment of the present invention provides an image forming apparatus that includes an image carrier; a toner image forming unit configured to form a toner image having a predetermined polarity on the image carrier; an intermediate transfer body facing the image carrier; a primary transfer member configured to transfer the toner image on the image carrier onto the intermediate transfer body; a secondary transfer member configured to transfer the toner image on the intermediate transfer body onto a recording medium; and a contacting member that is in contact with the image carrier and configured to remove residual toner remaining on the image carrier after the toner image is transferred by the primary transfer member onto the intermediate transfer body and to pass the removed residual toner to the intermediate transfer body, to which contacting member a bias voltage with the same polarity as the predetermined polarity of the toner image is applied.

Another embodiment of the present invention provides a process cartridge that includes an image carrier; a toner image forming unit configured to form a toner image having a predetermined polarity on the image carrier; a contacting member that is in contact with the image carrier and configured to remove residual toner remaining on the image carrier after the toner image is transferred onto an image receiving body; and a bias applying unit configured to apply a bias voltage with the same polarity as the predetermined polarity of the toner image to the contacting member.

Still another embodiment of the present invention provides an image forming apparatus that includes an image carrier; an endless belt; a transfer member configured to transfer a toner image on the image carrier onto the endless belt; a contacting member that is in contact with the image carrier and configured to remove residual toner remaining on the image carrier after the toner image is transferred and to cause the removed residual toner to fall onto the endless belt by gravity, the contacting member being implemented by a sheet part, a roller brush, or a roller; and a toner reclaiming unit configured to reclaim and store the residual toner that has fallen onto the endless belt.

DESCRIPTION OF THE PREFERRED EMBODIMENTS

Preferred embodiments of the present invention are described below with reference to the accompanying drawings.

First Embodiment

Figure 1:
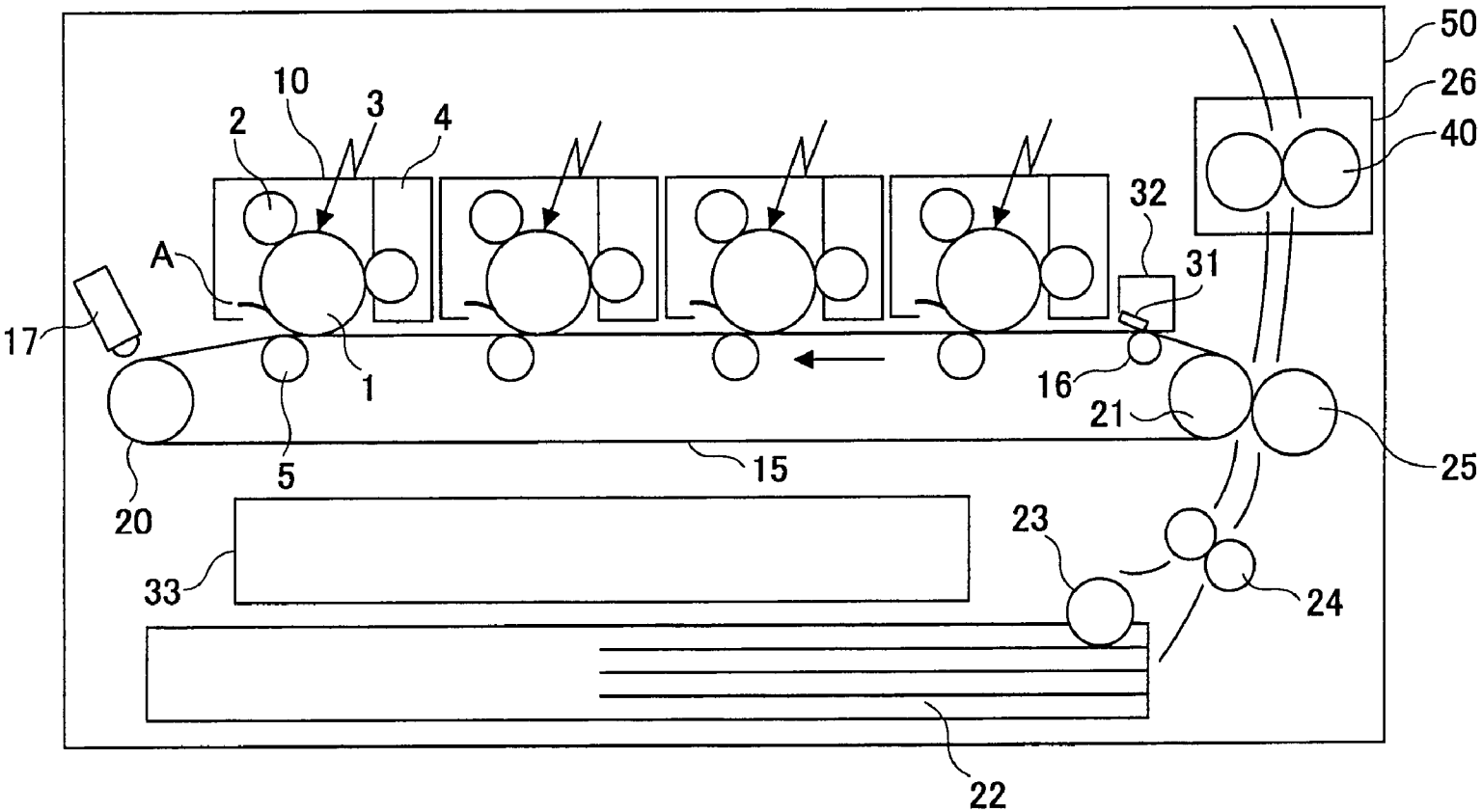
FIG. 1 is a drawing illustrating an exemplary image forming apparatus according to a first embodiment of the present invention.

FIG. 1 is a drawing illustrating an image forming apparatus 50 according to a first embodiment of the present invention. The image forming apparatus 50 includes cylindrical photoconductive drums 1 (hereafter may also be called photoconductors 1) used as image carriers. Each of the photoconductors 1, for example, has a diameter of 24 mm and rotates at a circumferential speed of 120 mm/s. A brush-shaped charging unit 2 is pressed against the photoconductor 1 and is configured to be rotated by the rotation of the photoconductor 1. With a DC bias voltage or a DC bias voltage with a superimposed AC voltage applied from a high-voltage power supply (not shown), the charging unit 2 uniformly charges the photoconductor 1. The surface potential of the photoconductor 1 when charged is, for example, about −500 V.

An exposing unit 3 used as a latent image forming unit exposes the photoconductor 1 according to image data and thereby forms an electrostatic latent image. For example, a LED or a laser beam scanner implemented by a laser diode is used to expose the photoconductor 1.

A one-component contact developing unit 4 used as a toner image forming unit develops the electrostatic latent image on the photoconductor 1 with a developing bias (may be either a plus or minus voltage) supplied from a high-voltage power supply (not shown) and thereby forms a toner image. The developing unit 4, for example, initially contains about 180 g of one-component toner.

The photoconductor 1, the charging unit 2, and the developing unit 4 are integrated as a process unit 10. Four process units 10 corresponding to yellow (Y), magenta (M), cyan (C), and black (Bk) are provided in the image forming apparatus 50. When forming a full color image, the image forming apparatus 50 forms yellow, magenta, cyan, and black toner images in the order mentioned on the photoconductors 1, and transfers and superposes the toner images onto an intermediate transfer belt 15 being always in contact with the photoconductors 1.

The intermediate transfer belt 15 is used as an intermediate transfer body and is stretched over a drive/secondary-transfer roller 21, a cleaning roller 16 made of a metal, primary transfer rollers 5 used as primary transfer members, and a tension roller 20. The intermediate transfer belt 15 is rotated by a drive motor (not shown) via the drive/secondary-transfer roller 21. The tension roller 20 is biased by springs at both its ends to tension the intermediate transfer belt 15. The tension roller 20, for example, is made of an aluminum pipe with a diameter of about 20 mm and has collars (not shown) having a diameter of about 24 mm. The collars are pressed into the ends of the tension roller 20 and function as movement limiting parts that prevent the intermediate transfer belt 15 from moving sideways.

As the drive/secondary-transfer roller 21, a polyurethane-rubber-coated roller (e.g. with a coating thickness between 0.3 and 1 mm) and a thin-layer coated roller (e.g. with a coating thickness between 0.03 and 0.1 mm) may be used. Also, a urethane coated roller (e.g. with a coating thickness of 0.05 mm and a diameter of 20 mm), whose diameter is less susceptible to temperature change, is more preferably used as the drive/secondary-transfer roller 21. In this embodiment, it is assumed that a urethane coated roller is used as the drive/secondary-transfer roller 21.

Each of the primary transfer rollers 5 may be implemented by, for example, a conductive blade, a conductive sponge roller, or a metal roller. In this embodiment, a metal roller with a diameter of about 8 mm is used. Each of the primary transfer rollers 5 is offset, for example, 8 mm from the corresponding photoconductor 1 in the direction of movement of the intermediate transfer belt 15, and is offset, for example, 1 mm from the corresponding photoconductor 1 in the vertically upward direction. A transfer bias of, for example, between +500 and +1000 V is applied to the primary transfer rollers 5 from one high-voltage power supply (not shown) to form a transfer electric field via the intermediate transfer belt 15 and thereby to transfer toner images on the photoconductors 1 to the intermediate transfer belt 15.

A toner mark (TM) sensor 17 is implemented by, for example, a specular reflection sensor or a diffusion sensor and configured to measure the densities and positions of toner images of different colors on the intermediate transfer belt 15 to adjust the densities and positions.

An intermediate transfer belt cleaning unit 32 removes post-transfer residual toner on the intermediate transfer belt 15 by scraping the residual toner with a cleaning blade 31. The cleaning blade 31 is, for example, made of polyurethane rubber with a thickness between 1.5 and 3 mm and a hardness between 65 and 80° and is pressed against the intermediate transfer belt 15. The residual toner scraped by the cleaning blade 31 goes through a toner carrying path (not shown) and is stored in a waste toner container 33. A lubricant, a toner, or a coating agent such as zinc stearate is applied during the manufacturing process at least to the edge of the cleaning blade 31 or a portion of the intermediate transfer belt 15 corresponding to a cleaning nip (where the cleaning blade 31 and the intermediate transfer belt 15 come close to or contact each other) to prevent the cleaning blade 31 from riding up at the cleaning nip and to improve the cleaning performance by forming a dam layer on the portion corresponding to the cleaning nip.

The rollers over which the intermediate transfer belt 15 is stretched are supported by side boards on the sides of the intermediate transfer belt 15.

The intermediate transfer belt 15 is, for example, an endless belt of a resin film made by dispersing a conductive material such as carbon black in polyvinylidene difluoride (PVDF), polyethylene-tetrafluoroethylene (ETFE), polyimide (PI), polycarbonate (PC), or thermoplastic elastomer (TPE). In this embodiment, the intermediate transfer belt 15 is made by adding carbon black to TPE with a tensile modulus between 1000 and 2000 MPa. The intermediate transfer belt 15 of this embodiment has a single layer structure, a thickness between 100 and 200 μm, and a width of 230 mm.

The volume resistivity of the intermediate transfer belt 15 is preferably between $10^8$ and $10^{11}$ Ω·cm and the surface resistivity is preferably between $10^8$ and $10^{11}$ Ω/sq. (both measured with HIRESTA-UP MCP-HT450 of Mitsubishi Chemical Corporation by applying a voltage of 500 V for 10 seconds). If the volume resistivity and the surface resistivity of the intermediate transfer belt 15 are larger than the ranges mentioned above, the intermediate transfer belt 15 becomes charged, and therefore it becomes necessary to gradually increase the voltage applied to the primary transfer rollers 5 from upstream to downstream in terms of the toner image transfer process. Also, in this case, it may become necessary to use multiple power supplies to apply different voltages to the primary transfer rollers 5. This problem occurs because the electrostatic potential on the surface of the intermediate transfer belt 15 increases because of discharge, which occurs when toner images are transferred or a recording medium is peeled off, to such an extent that it becomes difficult for the intermediate transfer belt 15 to self-discharge. This in turn makes it necessary to provide a discharging unit for discharging the intermediate transfer belt 15. On the other hand, if the volume resistivity and the surface resistivity of the intermediate transfer belt 15 are smaller than the ranges mentioned above, the electrostatic potential on the surface of the intermediate transfer belt 15 decays sooner and therefore it is preferable in terms of self-discharging. However, with such low resistivity, the electric current flows in the plane direction during toner image transfer and toner on the intermediate transfer belt 15 may scatter. For these reasons, the volume resistivity and the surface resistivity of the intermediate transfer belt 15 are preferably within the above mentioned ranges.

A secondary transfer roller 25 is, for example, made by coating a metal core bar of stainless used steel (SUS) with an elastic body such as urethane whose resistance is adjusted by a conductive material to fall within a range between $10^6$ and $10^{10}$Ω. For example, the secondary transfer roller 25 may be implemented by an ion-conductive roller (made of urethane+carbon dispersion, nitrile-butadien rubber (NBR), or Hydrin) or an electronic conductive roller (made of ethylene–propylene terpolymer (EPDM)). In this embodiment, a urethane roller with a diameter of 20 mm and an Asker C hardness between 35 and 50° is used as the secondary transfer roller 25. If the volume resistivity and the surface resistivity of the secondary transfer roller 25 are larger than the ranges mentioned above, the passage of an electric current is hampered and it becomes necessary to apply a higher voltage to properly transfer toner images. This in turn increases the power supply cost. Also, if a high voltage is applied, a discharge occurs in a gap before or after a transfer nip (where the secondary transfer roller 25 and the intermediate transfer belt 15 come close to or contact each other) and causes white spots on a halftone image formed on a recording medium. This problem is especially prominent in a low-temperature and low-humidity environment (e.g. 10° C., 15% RH). On the other hand, if the volume resistivity and the surface resistivity of the secondary transfer roller 25 are smaller than the ranges mentioned above, it becomes difficult to transfer both a multi-color portion (e.g. composed of three colors) and a single-color portion of an image with the same quality. While a single-color portion of an image can be transferred with a low voltage or with a low transfer current, a voltage higher than the optimum voltage for a single-color portion is necessary to properly transfer a multi-color portion of an image. If a voltage high enough to transfer a multi-color portion is used, the transfer current becomes too high for a single-color portion, and the efficiency in transferring toner images is reduced.

The resistivity of the secondary transfer roller 25 can be obtained, for example, by placing the secondary transfer roller 25 on a conductive metal plate, applying a load of 4.9 N to each end of the metal core bar of the secondary transfer roller 25, and measuring the current that flows between the metal core bar and the metal plate when a voltage of 1 kV is applied between them.

A recording medium 22 is fed by a paper feed roller 23 and resist rollers 24 at a timing when the leading edge of a toner image on the intermediate transfer belt 15 reaches a secondary transfer position, and a transfer bias voltage is applied from a high-voltage power supply (not shown) to the secondary transfer roller 25 to transfer the toner image to the recording medium 22. The recording medium 22 is separated from the intermediate transfer belt 15 by the curvature of the drive/secondary-transfer roller 21. Then, fusing rollers 40 of a fusing unit 26 fuse the toner image onto the recording medium 22 and eject the recording medium 22.

In this embodiment, the amount of time used for the fusing process is changeable according to the type of the recording medium 22. For example, when the grammage of the recording medium 22 is greater than 100 g/m$^2$, the recording medium 22 is caused to pass through a fusing nip (or a gap) between the fusing rollers 40 at half of the normal speed so that the toner image is securely fused on the recording medium 22.

EXAMPLES

A test apparatus having substantially the same configuration as that of the image forming apparatus 50 shown in FIG. 1 was prepared to perform experiments. A sheet part was provided for each of plural photoconductors and positioned upstream of a charging brush roller so as to be in contact with the corresponding photoconductor. A monochrome halftone image was printed in succession on 3,000 sheets of A4-size paper by each of the photoconductors (with an exposure temperature between 22 and 25° C. and an environmental humidity between 50 and 70%). The percentage of the area occupied by the monochrome halftone image on the A4-size paper was 5%. Then, for each of the sheet parts, the degree of a ghost image on the 3,000th page was evaluated. To indicate the degree of a ghost image, the following marks were used: ○ indicating that no ghost image is visible; Δ indicating that a faint ghost image is visible; and x indicating that a ghost image is clearly visible. Also, the number of black lines appearing on an image, which black lines are caused by a tainted charging brush roller, was used to indicate the effectiveness of the sheet parts (i.e. how effectively post-transfer residual toner and reverse-transferred toner are scraped by the sheet parts). Such black lines appear on the monochrome halftone image, for example, if black (Bk) toner adheres to a portion of the sheet part in a Bk process unit and, as a result, oppositely-charged black toner accumulates on a corresponding portion of the charging brush roller. In this experiment, the following marks were used to indicate the number of black lines on the monochrome halftone image printed on the 3,000th page: ○ indicating that the number of black lines is 0; Δ indicating that the number of black lines is 1 to 2; and x indicating the number of black lines is more than 3. Also, as a comparative example, an experiment was performed in the same manner using a blade instead of a sheet part. As a blade, a SUS plate with a thickness of 100 μm, a mounting angle of 17°, and a cut-in depth of 0.5 mm was used.

As the black toner, spherical toner particles having an average diameter of 6 μm and coated with a sizing agent were used. Each of the photoconductors was prepared by stacking an underlying layer with a thickness of 3 μm, a charge generation layer with a thickness of 0.2 μm, and a charge transport layer with a thickness of 23 μm in this order on a drum. The capacitance of the photoconductors was 110 pF/cm$^2$. The photoconductors were rotated at a linear velocity of 120 mm/s during printing.

The charging brush roller was prepared by implanting conductive fibers into a rotational shaft with a diameter of 5 mm. The external diameter of the charging brush roller was 11 mm. As a charging bias applied to the charging brush roller, an AC voltage with a superimposed DC voltage Vdc of −500 V was used. The AC voltage had a peak-to-peak voltage level Vpp of 1.0 kV, a printing time frequency of 300 Hz, a non-printing time (between recording media) frequency of 10 Hz, and a duty cycle of 45%. Decreasing the frequency from 300 Hz (during printing) to 10 Hz (in an interval between recording media) makes it possible for the charging brush roller to release toner adhering to itself onto the photoconductor. The released toner is reclaimed by the developing unit from the photoconductor. However, it is difficult to reclaim low-charged toner. Also, even when the frequency is decreased to 10 Hz, oppositely-charged toner is not released from the charging brush roller and accumulates on the charging brush roller.

As the sheet part, a conductive sheet with a thickness of 0.1 mm and made of a material obtained by dispersing carbon powder used as a conductive material in polyvinylidene difluoride (PVDF) was used. The volume resistivity of the conductive sheet was between 105 and 107 Ω·cm, and the surface resistivity was 102 Ω/sq. The results of the above experiments are shown in table 1 below as examples 1 through 3 and comparative examples 1 through 4.

TABLE 1

| | Shape of Part | Bias (V) | Ghost Image | Black Lines |
|---|---|---|---|---|
| Example 1 | Sheet (PVDF) | −300 | ○ | ○ |
| Example 2 | Sheet (PVDF) | −500 | ○ | ○ |
| Example 3 | Sheet (PVDF) | −700 | ○ | Δ |
| Comparative 1 | Sheet (PVDF) | 0 | X | X |
| Comparative 2 | Sheet (PVDF) | −100 | X | Δ |
| Comparative 3 | Sheet (PVDF) | −1000 | ○ | X |
| Comparative 4 | Blade (SUS) | 0 | X | Δ |

Biases having the same polarity as the charge polarity of toner were applied to the sheet parts and the blade. When voltages of −300 V and −500 V were applied, respectively, to the sheet parts in examples 1 and 2, no ghost image or black line was observed. When voltages lower than −300 V were applied to the sheet parts, both ghost images and black lines were observed. It is assumed that this is because potential irregularities on the photoconductor just after image transfer cannot be corrected if an applied bias is low. It is also assumed that black lines appear on the monochrome halftone image when almost no bias is applied to the sheet part because post-transfer residual toner and reverse-transferred toner are not attracted to the sheet part and, since the mechanical strength of the sheet part is low, easily pass by the sheet part and taint the charging brush roller.

When biases higher than −500 V were applied, no ghost image was observed. With a bias higher than −700 V, however, many black lines were observed. It is assumed that this is because oppositely-charged toner sticks to the edge of the sheet part if the applied bias is too high, changes the strength of the edge of the sheet part, and thereby causes the toner to slip by the sheet part and taint the charging brush roller.

When the blade was used instead of the sheet part in comparative example 4, ghost images and a couple of black lines were observed. It is assumed that this is because potential irregularities on the photoconductor just after image transfer cannot be corrected since no bias is applied to the blade. Also, with the blade, the post-transfer residual toner and the reverse-transferred toner were not removed satisfactorily.

As the results show, applying a bias voltage between −300 and −700 V to a sheet part makes it possible to correct potential irregularities on the photoconductor, which irregularities cause ghost images, and to efficiently remove and cause the post-transfer residual toner and the reverse-transferred toner to fall onto the intermediate transfer belt by gravity. Also, using a sheet part in contact with the photoconductor to remove and cause residual toner on the photoconductor to fall onto the intermediate transfer belt makes it possible to implement a cleaner-less developing system with a minimum configuration and at low costs.

Second Embodiment

Figure 2:
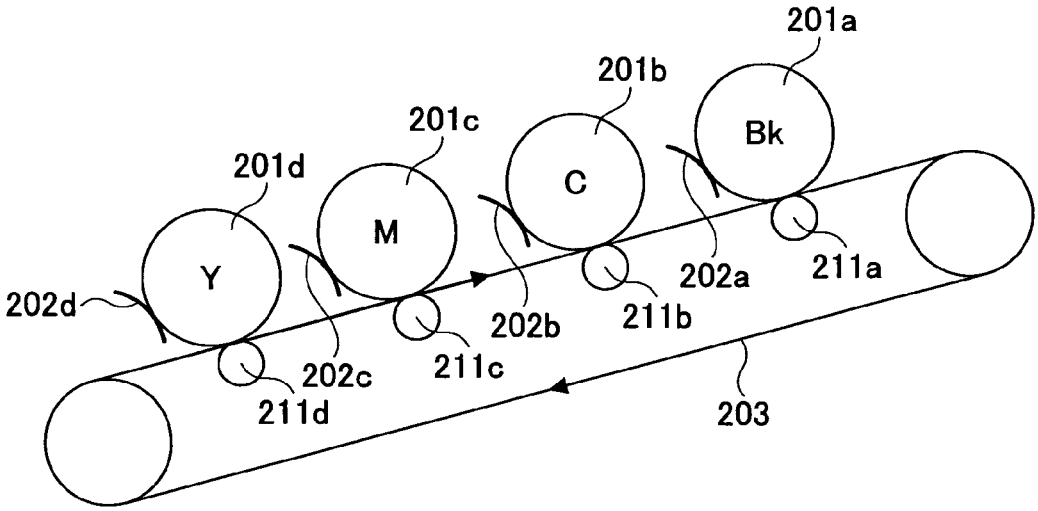
FIG. 2 is a schematic diagram illustrating a part of an exemplary image forming apparatus according to a second embodiment of the present invention.

FIG. 2 is a schematic diagram illustrating a part of an exemplary image forming apparatus according to a second embodiment of the present invention. In the configuration shown in FIG. 2, sheet parts 202*a* through 202*d* (hereafter may also be called sheet parts 202; the sheet parts are indicated by "A" in FIG. 1) are positioned so as to be in contact with photoconductors 201*a* through 201*d* (hereafter may also be called photoconductors 201) and not to touch an intermediate transfer belt 203. The sheet parts 202 scrape residual toner on the photoconductors 201 and cause the scraped toner to fall onto the intermediate transfer belt 203 by gravity. In other words, the sheet parts 202 pass scraped toner to the intermediate transfer belt 203 without contact, and therefore do not disturb toner images. The sheet part 202 has a smoothly-curved shape or a substantially smoothly-curved shape (however, the shape of the sheet part 202 is not limited to an arc shown in FIG. 2). The sheet part 202 is in contact with the photoconductor 201 in the middle or in approximately the middle of the curved shape in a forward direction (opposite to a counter direction) with respect to the rotational direction of the photoconductor 201. The sheet part 202 is preferably made of conductive nylon 12. This configuration makes it possible to implement a cleaner-less image forming apparatus configured to prevent post-transfer residual toner on a photoconductor from entering a developing unit and thereby to prevent color shift that is a problem in conventional cleaner-less image forming apparatuses. In FIG. 2, reference numbers 211*a* through 211*d* indicate primary transfer rollers. Other components of the exemplary image forming apparatus may be configured in a similar manner to the image forming apparatus 50 shown in FIG. 1 or may be configured in any other manner. Therefore, illustrations and descriptions of other components of the exemplary image forming apparatus are omitted here.

Third Embodiment

Figure 3:
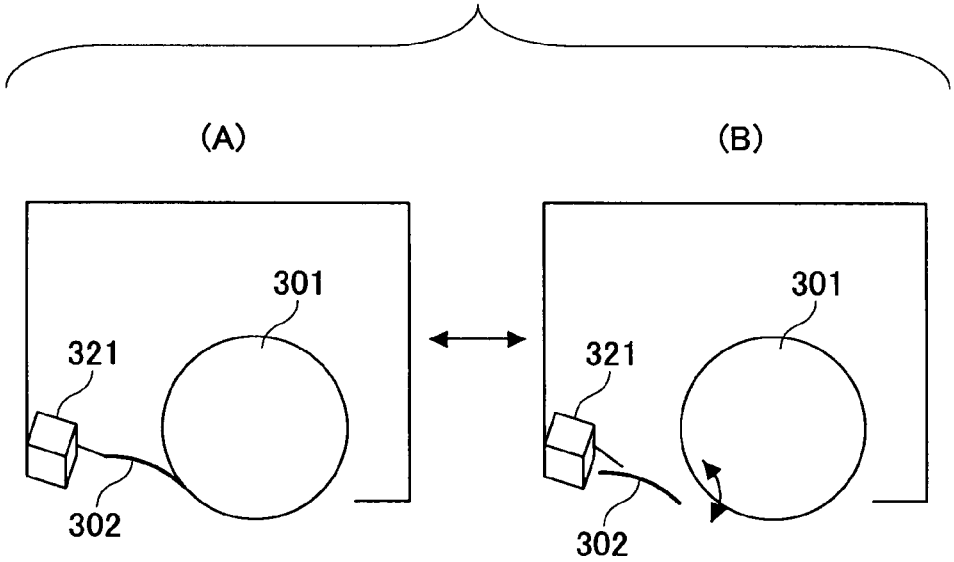
FIG. 3 is a schematic diagram illustrating a part of an exemplary image forming apparatus according to a third embodiment of the present invention.

FIG. 3 is a schematic diagram illustrating a part of an exemplary image forming apparatus according to a third embodiment of the present invention. If a sheet part is always in contact with a photoconductor (especially when it is in contact with the photoconductor in a direction counter to the rotational direction of the photoconductor), the sheet part continuously wears and degrades the photoconductor. In this embodiment, a retracting mechanism 321 is provided to retract or pull a sheet part 302 away from a photoconductor 301 when toner images are not being transferred and thereby to reduce abrasion of the photoconductor 301. This configuration makes it possible to lengthen the service life of an image carrier.

Fourth Embodiment

Figure 4:
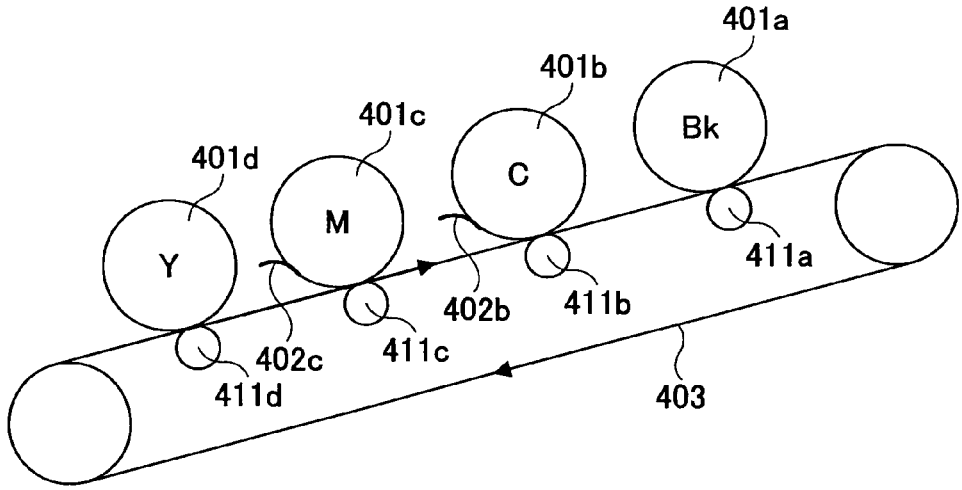
FIG. 4 is a schematic diagram illustrating a part of an exemplary image forming apparatus according to a fourth embodiment of the present invention.

FIG. 4 is a schematic diagram illustrating a part of an exemplary image forming apparatus according to a fourth embodiment of the present invention. In the exemplary image forming apparatus of this embodiment, photoconductors 401*a* through 401*d* (hereafter may also be called photoconductors 401) corresponding to yellow (Y), magenta (M), cyan (C), and black (Bk) are arranged in the order mentioned along the rotational direction of an intermediate transfer belt 403 (i.e. yellow is the most upstream color). Also, primary transfer rollers 411*a* through 411*d* (hereafter may also be called primary transfer rollers 411) are provided in the exemplary image forming apparatus. Each of the primary transfer rollers 411 is positioned 5-10 mm downstream of the corresponding one of the photoconductors 401 so that their rotational axes are offset from each other. The press-in amount (the amount by which the primary transfer roller 411 is pushed across a tangent to the lowest point of the photoconductor 401) between the primary transfer roller 411 and the photoconductor 401 when forming a color image is set to 0.5 mm. Since the primary transfer roller 411 is offset from the corresponding photoconductor 401, the primary transfer roller 411 can cause the intermediate transfer belt 403 to form a transfer nip (where the intermediate transfer belt 403 and the photoconductor 401 come close to or contact each other) with the photoconductor 401 without directly pressing the photoconductor 401. This configuration in turn makes it possible to determine the hardness of the primary transfer roller 411 without taking into account its influence on the image transfer quality. In other words, using an offset transfer method makes it possible to increase the area of contact (or the width of the transfer nip) between the photoconductor 401 and the intermediate transfer belt 403, to reduce a pre-nip discharge, and thereby to reduce generation of positively polarized toner that is easily reverse-transferred. Alternatively, when the primary transfer roller 411 is directly below the photoconductor 401, it is possible to prevent degradation of image quality by distributing the pressure evenly within the transfer nip. The offset amount and the press-in amount can be set freely as long as the gap between the photoconductor 401 and the primary transfer roller 411 becomes greater than the thickness of the intermediate transfer belt 403.

Also, in this embodiment, sheet parts (402*b* and 402*c*) are provided only for the magenta photoconductor 401*c* and the cyan photoconductor 401*b*, and not provided for the yellow photoconductor 401*d* (positioned most upstream) and the black photoconductor 401*a* (positioned most downstream). Even with this configuration, the yellow toner in the developing unit corresponding to the yellow photoconductor 401*d* is not mixed with toner of another color. The black photoconductor 401*a* is configured to reclaim the magenta toner and the cyan toner that are passed to the intermediate transfer belt 403. Even if the black toner is mixed with toner of a different color, the influence is very small. Rather, reclaiming toner by the black photoconductor 401*a* makes it possible to reduce toner consumption and has an advantage in terms of ecology. Further, since this embodiment requires the sheet parts 402 only for two photoconductors, it is possible to reduce the size and costs of an image forming apparatus.

Fifth Embodiment

Figure 5:
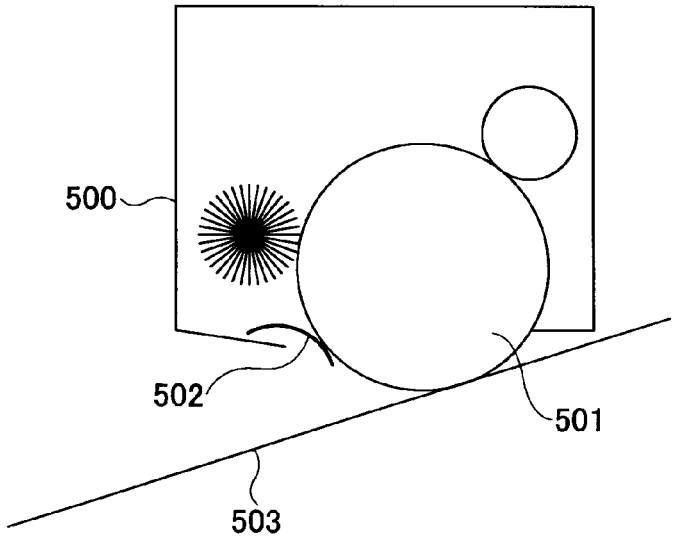
FIG. 5 is a schematic diagram illustrating a part of an exemplary image forming apparatus according to a fifth embodiment of the present invention.

FIG. 5 is a schematic diagram illustrating a part of an exemplary image forming apparatus according to a fifth embodiment of the present invention. In this embodiment, a sheet part 502 is integrated with a process cartridge 500. This configuration makes it possible to precisely align the sheet part 502 and the photoconductor 501 at a contact position. Also, this configuration makes it easier to replace the sheet part 502, since it is replaced together with the process cartridge 500. In FIG. 5, 503 indicates an intermediate transfer belt (or an image receiving body).

Sixth Embodiment

Figure 6:
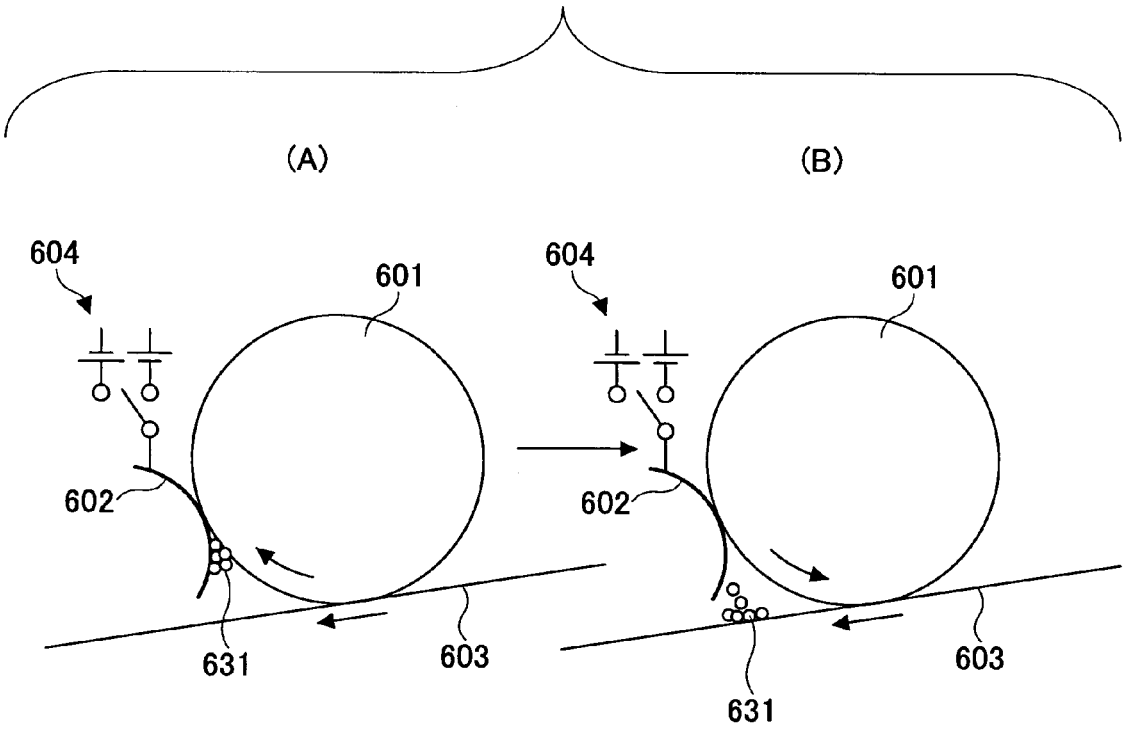
FIG. 6 is a schematic diagram illustrating a part of an exemplary image forming apparatus according to a sixth embodiment of the present invention.

FIG. 6 is a schematic diagram illustrating a part of an exemplary image forming apparatus according to a sixth embodiment of the present invention. In this embodiment, a photoconductor 601, which normally rotates in the direction (normal direction) indicated by an arrow in FIG. 6 (A), is caused to rotate in the reverse direction as indicated by an arrow in FIG. 6 (B) immediately after a position and density adjustment process that is performed each time after printing, for example, 200 pages. A bias voltage is applied from an AC power supply (bias applying unit) 604 to a sheet part 602 when the photoconductor 601 is being rotated in the reverse direction to cause residual toner 631 reclaimed by the sheet part 602 to fall onto a non-image area (onto which no toner image is transferred) of an intermediate transfer belt 603. This configuration makes it possible to remove reverse-transferred toner and to prevent formation of ghost images caused by potential irregularities using the sheet part 602 instead of a large cleaning device. Applying a bias voltage to the sheet part 602 while the photoconductor 601 is being rotated in the reverse direction helps oppositely-polarized toner and highly-adhesive toner reclaimed by the sheet part 602 to fall onto the intermediate transfer belt 603. The exemplary image forming apparatus may also include a cleaning unit for reclaiming the toner that has fallen onto the intermediate transfer belt 603.

In the above embodiments, it is preferable to apply a bias voltage to a sheet part used as a contacting member before residual toner reaches a position where the sheet part touches a photoconductor used as an image carrier. Also in the above embodiments, a sheet part is pre-charged by a bias voltage. However, a sheet part may also be used to charge a photoconductor. Although a sheet part having a low mechanical strength is most preferable as a contacting member, a brush or a blade may also be used as a contacting member. As described above, a sheet part or a contacting member that removes residual toner is preferably in contact with a photoconductor or an image carrier in a forward direction that is opposite to a counter direction with respect to the rotational direction of the photoconductor. However, depending on the material of the photoconductor or other conditions, the sheet part may be brought into contact with the photoconductor in a counter direction with respect to the rotational direction of the photoconductor to efficiently scrape and hold residual toner on the photoconductor.

Examples of materials used for a sheet part include nylon 6, nylon 12, vinylon, saran, rayon, polyethylene, acrylic resin, and fluoroplastics (e.g. PVDF, PFA, and PTFE).

Another embodiment of the present invention provides an image forming apparatus including cleaner-less process cartridges corresponding to different colors each of which process cartridges includes an image carrier and a developing unit but does not include a cleaning device for removing toner remaining on the image carrier after image transfer. In the image forming apparatus, toner images of different colors are formed on the image carriers by the developing units of the process cartridges, which process cartridges are positioned vertically above an intermediate transfer body, and the formed toner images are transferred to and superposed on the intermediate transfer body. A contacting member is provided for at least one of the image carriers which contacting member is in contact with the corresponding image carrier and positioned upstream of a charging unit. A bias voltage is applied to the contacting member. The contacting member is configured to remove toner remaining on the image carrier after image transfer and pass the removed toner to the intermediate transfer body. This configuration makes it possible to prevent toner of one color in a developing unit from being mixed with reverse-transferred toner of another color. Also, applying a bias voltage to the contacting member improves efficiency in passing residual toner to the intermediate transfer body and makes it possible to reduce potential irregularities on the image carrier just after image transfer and thereby to reduce formation of ghost images.

In the image forming apparatus described above, the contacting member in contact with the image carrier is preferably positioned so as not to contact the intermediate transfer body. This configuration prevents the contacting member from disturbing toner images on the intermediate transfer body. Also, the contacting member may be configured to cause residual toner to fall onto the intermediate transfer body by gravity. Further, a primary transfer member of the image forming apparatus and the corresponding image carrier are preferably offset from each other, and the primary transfer member is preferably configured to cause the intermediate transfer body to form a primary transfer nip with the image carrier without directly pressing the image carrier. This configuration makes it possible to increase the area of contact (or the width of the transfer nip) between the image carrier and the intermediate transfer body, to reduce a pre-nip discharge, and thereby to reduce generation of positively polarized toner that is easily reverse-transferred. Alternatively, when the primary transfer member is directly below the image carrier, it is possible to prevent degradation of image quality by distributing the pressure evenly within the transfer nip.

The image forming apparatus described above may be configured such that the toner images transferred onto the intermediate transfer body are then transferred onto a recording medium, and the contacting member is integrated with the process cartridge and is in contact with the image carrier at a position downstream of the primary transfer nip.

Still another embodiment of the present invention provides an image forming apparatus including process cartridges corresponding to different colors, each of which process cartridges includes an image carrier and a developing unit and is positioned vertically above an intermediate transfer body disposed so as to form an angle with the bottom surface of the image forming apparatus. In the image forming apparatus, toner images of different colors are formed on the image carriers by the developing units of the process cartridges, and the formed toner images are transferred to and superposed on the intermediate transfer body. A cleaning part is provided for at least one of the image carriers. The cleaning part is in contact with the corresponding image carrier in approximately the middle of the cleaning part and is configured to remove and temporarily hold toner remaining on the image carrier after image transfer. The toner held by the cleaning part is passed to the intermediate transfer body when the image carrier is rotated in the reverse direction at predetermined intervals (or at a predetermined timing). This configuration makes it possible to provide a small and low-cost cleaning mechanism that prevents toner of one color in a developing unit from being mixed with reverse-transferred toner of another color.

In this image forming apparatus, the image carrier is preferably rotated in the reverse direction at such a timing that the removed residual toner falls onto a non-image area of the intermediate transfer body. This configuration makes it possible to prevent toner images on the intermediate transfer body from being disturbed. The predetermined intervals at which the image carrier is rotated in the reverse direction may correspond to the intervals of control processes. In other words, the image carrier may be rotated in the reverse direction before and after a control process. In the present application, a control process indicates a process for adjusting various characteristics of an image forming apparatus which characteristics influence image quality. For example, a control process is performed to align recording heads, to adjust toner concentration, to correct gamma, or to adjust fusing temperature. The intervals (or the timing) may also be determined based on a cumulative number of rotations of an image carrier or a cumulative number of rotations of an intermediate transfer body. Further, the image forming apparatus described above may be configured to apply a bias voltage to the cleaning part when the image carrier is rotated in the reverse direction to help the residual toner removed by the cleaning part to fall onto the intermediate transfer body.

Thus, embodiments of the present invention provide an image forming apparatus and a process cartridge used in the image forming apparatus that make it possible to prevent toner of one color remaining on an image carrier after image transfer from being mixed with toner of a different color in a developing unit and causing a color shift. At the same time, embodiments of the present invention make it possible to reduce the size of an image forming apparatus and to provide an ecologically-friendly image forming apparatus that can reduce toner consumption and reduce or substantially eliminate waste toner.

In an image forming apparatus according to an embodiment of the present invention, a contacting member is provided at least for one of image carriers, to which contacting member a bias voltage is applied. The contacting member is configured to remove reverse-transferred toner on the corresponding image carrier and to pass the removed toner to an intermediate transfer body. This configuration effectively prevents toner of one color in a developing unit from being mixed with reverse-transferred toner of another color.

Seventh Embodiment

Figure 7:
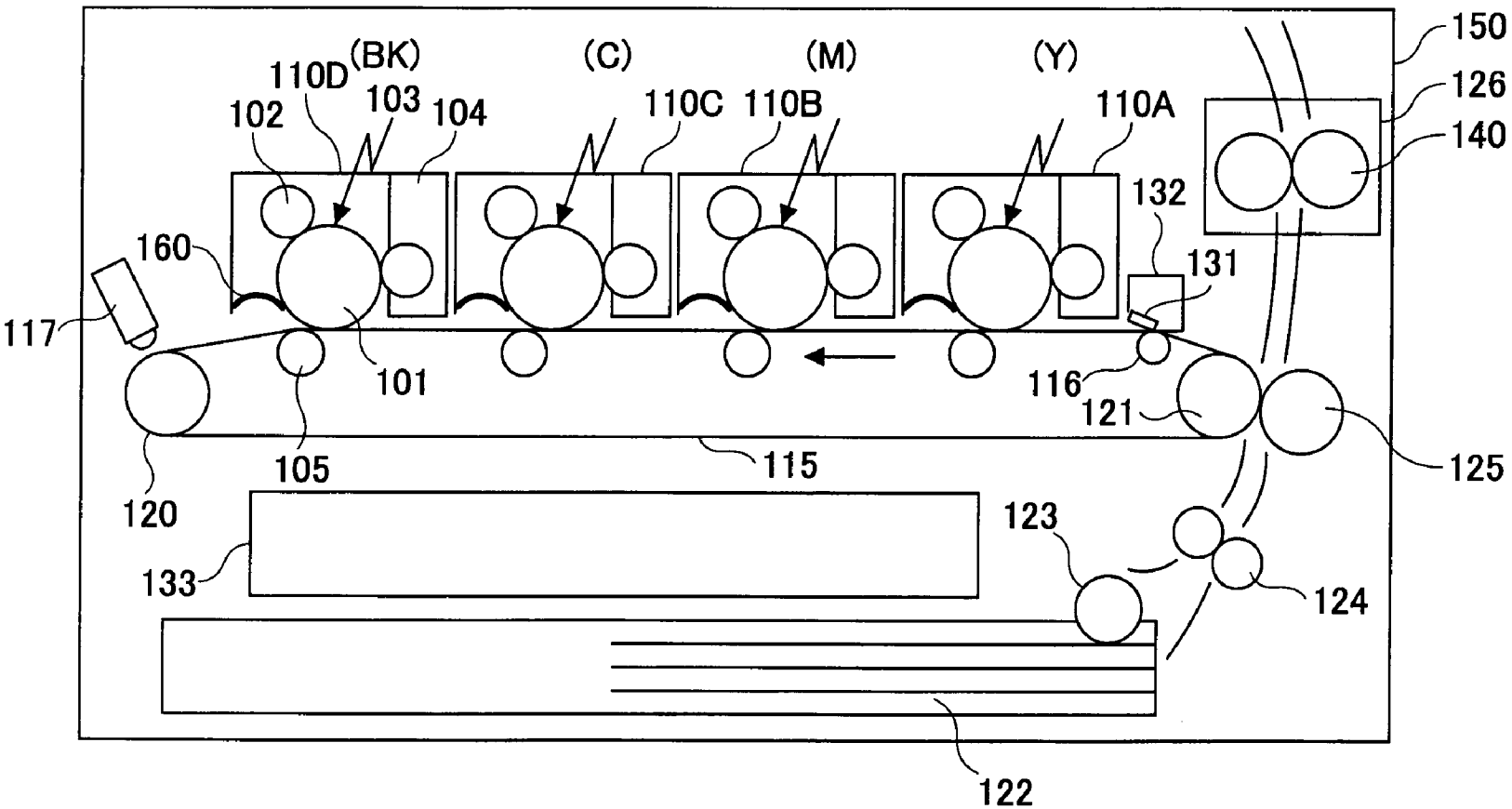
FIG. 7 is a drawing illustrating an exemplary image forming apparatus according to a seventh embodiment of the present invention.

FIG. 7 is a drawing illustrating an image forming apparatus 150 according to a seventh embodiment of the present invention. The image forming apparatus 150 includes cylindrical photoconductive drums 101. Each of the photoconductive drums 101, for example, has a diameter of 24 mm and rotates at a circumferential speed of 120 mm/s. A brush-shaped charging unit 102 is pressed against the photoconductive drum 101. With a DC bias voltage or a DC bias voltage with a superimposed AC voltage applied from a high-voltage power supply (not shown), the charging unit 102 uniformly charges the photoconductive drum 101 at about −500V. An exposing unit 103 used as a latent image forming unit exposes the photoconductive drum 101 according to image data and thereby forms an electrostatic latent image. For example, a LED or a laser beam scanner implemented by a laser diode is used to expose the photoconductive drum 101.

A one-component contact developing unit 104 develops the electrostatic latent image on the photoconductive drum 101 with a developing bias supplied from a high-voltage power supply (not shown) and thereby forms a toner image. The developing unit 104, for example, initially contains about 180 g of polyester one-component toner. The photoconductive drum 101, the charging unit 102, and the developing unit 104 are integrated as a process cartridge 110. Four process cartridges 110 (110A, 110B, 110C, and 110D) corresponding to yellow (Y), magenta (M), cyan (C), and black (Bk) are provided in the image forming apparatus 150. When forming a full color image, the image forming apparatus 150 forms yellow, magenta, cyan, and black toner images on the photoconductive drums 101 in the order mentioned, and transfers and superposes the toner images onto an intermediate transfer belt 115 being always in contact with the photoconductive drums 101.

The intermediate transfer belt 115 is used as an intermediate transfer body and is stretched over a drive/secondary-transfer roller 121, a cleaning roller 116, primary transfer rollers 105 used as primary transfer members, and a tension roller 120. The intermediate transfer belt 115 is rotated by a drive motor (not shown) via the drive/secondary-transfer roller 121. The tension roller 120 is biased by springs at both its ends to tension the intermediate transfer belt 115. The tension roller 120, for example, is made of an aluminum pipe with a diameter of about 20 mm and has collars having a diameter of about 24 mm. The collars are pressed into the ends of the tension roller 120 and function as movement limiting parts that prevent the intermediate transfer belt 115 from moving sideways.

As the drive/secondary-transfer roller 121, a polyurethane-rubber-coated roller (e.g. with a coating thickness between 0.3 and 1 mm) and a thin-layer coated roller (e.g. with a coating thickness between 0.03 and 0.1 mm) may be used. Also, a urethane coated roller (e.g. with a coating thickness of 0.05 mm and a diameter of 20 mm), whose diameter is less susceptible to temperature change, is more preferably used as the drive/secondary-transfer roller 121. Each of the primary transfer rollers 105 may be implemented by, for example, a conductive blade, a conductive sponge roller, or a metal roller. In this embodiment, a metal roller with a diameter of about 8 mm is used. Each of the primary transfer rollers 105 is offset, for example, 8 mm from the corresponding photoconductive drum 101 in the direction of movement of the intermediate transfer belt 115, and is offset, for example, 1 mm from the corresponding photoconductive drum 101 in the vertically upward direction. A transfer bias of, for example, between +500 and +1000 V is applied to the primary transfer rollers 105 from one high-voltage power supply (not shown) to form a transfer electric field via the intermediate transfer belt 115 and thereby to transfer toner images on the photoconductive drums 101 to the intermediate transfer belt 115.

Sheet parts 160 are provided for the photoconductive drums 101. Each of the sheet parts 160 is disposed downstream of a primary transfer area and is configured to remove post-transfer residual toner and reverse-transferred toner on the photoconductive drum 101 and to pass the removed toner to the intermediate transfer belt 115. The toner passed to the intermediate transfer belt 115 by an upstream process cartridge 110 may be reclaimed by a downstream process cartridge 110. In this case, it is preferable to positively charge polyester toner having a negative polarity. Also in this case, the sheet part 160 is preferably made of polyurethane or a fluoroplastic (e.g. PVDF, PFA, or PTFE) that is ranked lower (closer to the most negatively charged side) in the triboelectric series than polyester. Especially, a fluoroplastic, which is a highly negative material, is preferably used.

A toner mark (TM) sensor 117 is implemented by, for example, a specular reflection sensor or a diffusion sensor and configured to measure the densities and positions of toner images of different colors on the intermediate transfer belt 115 to adjust the densities and positions. An intermediate transfer belt cleaning unit 132 removes post-transfer residual toner on the intermediate transfer belt 115 by scraping the toner with a cleaning blade 131. The cleaning blade 131 is, for example, made of polyurethane rubber with a thickness between 1.5 and 3 mm and a hardness between 65 and 80° and is pressed against the intermediate transfer belt 115. The residual toner scraped by the cleaning blade 131 goes through a toner carrying path (not shown) and is stored in a waste toner container 133. A lubricant, toner, or a coating agent such as zinc stearate is applied during the manufacturing process at least to the edge of the cleaning blade 131 or a portion of the intermediate transfer belt 115 corresponding to a cleaning nip (where the cleaning blade 131 and the intermediate transfer belt 115 come close to or contact each other) to prevent the cleaning blade 131 from riding up at the cleaning nip and to improve the cleaning performance by forming a dam layer on the portion corresponding to the cleaning nip. The rollers over which the intermediate transfer belt 115 is stretched are supported by side boards on the sides of the intermediate transfer belt 115.

The intermediate transfer belt 115 is an endless belt of a resin film made, for example, by dispersing a conductive material such as carbon black in polyvinylidene difluoride (PVDF), polyethylene-tetrafluoroethylene (ETFE), polyimide (PI), polycarbonate (PC), or thermoplastic elastomer (TPE). In this embodiment, the intermediate transfer belt 115 is made of a material obtained by adding carbon black to TPE with a tensile modulus between 1000 and 2000 MPa. The intermediate transfer belt 115 of this embodiment has a single layer structure, a thickness between 100 and 200 μm, and a width of 230 mm.

The volume resistivity of the intermediate transfer belt 115 is preferably between $10^8$ and $10^{11}$ Ω·cm and the surface resistivity is preferably between $10^8$ and $10^{11}$ Ω/sq. (both measured with HIRESTA-UP MCP-HT450 of Mitsubishi Chemical Corporation by applying a voltage of 500 V for 10 seconds). If the volume resistivity and the surface resistivity of the intermediate transfer belt 115 are larger than the ranges mentioned above, the intermediate transfer belt 115 becomes charged, and therefore it becomes necessary to gradually increase the voltage applied to the primary transfer rollers 105 from upstream to downstream in terms of the toner image transfer process. Also, in this case, it may become necessary to use multiple power supplies to apply different voltages to the primary transfer rollers 105. This problem occurs because the electrostatic potential on the surface of the intermediate transfer belt 115 increases because of discharge, which occurs when toner images are transferred or a recording medium is peeled off, to such an extent that it becomes difficult for the intermediate transfer belt 115 to self-discharge. This in turn makes it necessary to provide a discharging unit for discharging the intermediate transfer belt 115. On the other hand, if the volume resistivity and the surface resistivity of the intermediate transfer belt 115 are smaller than the ranges mentioned above, the electrostatic potential on the surface of the intermediate transfer belt 115 decays sooner and therefore it is preferable in terms of self-discharging. However, with such low resistivity, the electric current flows in the plane direction during toner image transfer and toner on the intermediate transfer belt 115 may scatter. For these reasons, the volume resistivity and the surface resistivity of the intermediate transfer belt 115 are preferably within the above mentioned ranges.

A secondary transfer roller 125 is, for example, made by coating a metal core bar of stainless used steel (SUS) with an elastic body such as urethane whose resistance is adjusted by a conductive material to fall within a range between $10^6$ and $10^{10}$Ω. For example, the secondary transfer roller 125 may be implemented by an ion-conductive roller (made of urethane+carbon dispersion, nitrile-butadien rubber (NBR), or Hydrin) or an electronic conductive roller (made of ethylene–propylene terpolymer (EPDM)). In this embodiment, a urethane roller with a diameter of 20 mm and an Asker C hardness between 35 and 50° is used as the secondary transfer roller 125. If the volume resistivity and the surface resistivity of the secondary transfer roller 125 are larger than the ranges mentioned above, the passage of an electric current is hampered and it becomes necessary to apply a higher voltage to properly transfer toner images. This in turn increases the power supply cost. Also, if a high voltage is applied, a discharge occurs in a gap before or after a transfer nip (where the secondary transfer roller 125 and the intermediate transfer belt 115 come close to or contact each other) and causes white spots on a halftone image formed on a recording medium. This problem is especially prominent in a low-temperature and low-humidity environment (e.g. 10° C., 15% RH). On the other hand, if the volume resistivity and the surface resistivity of the secondary transfer roller 125 are smaller than the ranges mentioned above, it becomes difficult to transfer both a multi-color portion (e.g. composed of three colors) and a single-color portion of an image with the same quality. While a single-color portion of an image can be transferred with a low voltage or with a low transfer current, a voltage higher than the optimum voltage for a single-color portion is necessary to properly transfer a multi-color portion of an image. If a voltage high enough to transfer a multi-color portion is used, the transfer current becomes too high for a single-color portion, and the efficiency in transferring toner images is reduced.

The resistivity of the secondary transfer roller 125 can be obtained, for example, by placing the secondary transfer roller 125 on a conductive metal plate, applying a load of 4.9 N to each end of the metal core bar of the secondary transfer roller 125, and measuring the current that flows between the metal core bar and the metal plate when a voltage of 1 kV is applied between them.

A recording medium 122 is fed by a paper feed roller 123 and resist rollers 124 at a timing when the leading edge of a toner image on the intermediate transfer belt 115 reaches a secondary transfer position, and a transfer bias voltage is applied from a high-voltage power supply (not shown) to the secondary transfer roller 125 to transfer the toner image to the recording medium 122. The recording medium 122 is separated from the intermediate transfer belt 115 by the curvature of the drive/secondary-transfer roller 121. Then, fusing rollers 140 of a fusing unit 126 fuse the toner image onto the recording medium 122 and eject the recording medium 122.

In this embodiment, the amount of time used for the fusing process is changeable according to the type of the recording medium 122. For example, when the grammage of the recording medium 122 is greater than 100 g/m$^2$, the recording medium 122 is caused to pass through a fusing nip (or a gap) between the fusing rollers 140 at half of the normal speed so that the toner image is securely fused on the recording medium 122.

With the configuration described above, even if toner on the intermediate transfer belt 115 is reverse-transferred onto the photoconductive drum 101, the reverse-transferred toner is scraped and passed to the intermediate transfer belt 115 by the sheet part 160 of the process cartridge 110. The toner is then carried by the intermediate transfer belt 115, is scraped by the cleaning blade 131 of the intermediate transfer belt cleaning unit 132, and is stored through a toner carrying path in the waste toner container 133 (the intermediate transfer belt cleaning unit 132 and the waste toner container 133 may collectively be called a toner reclaiming unit). Thus, this configuration prevents post-transfer residual toner from entering the developing unit 104 and mixing with toner of a different color, and thereby prevents a color shift in the developing unit 104.

Also, the above configuration eliminates the need to provide a cleaning device with a housing as disclosed in patent document 2 and requires only the sheet part 160 for removing residual toner on the photoconductive drum 101, and therefore makes it possible to simplify and reduce the size of an image forming apparatus. In other words, the above configuration makes it possible to reduce the number of components of an image forming apparatus and to reduce the production costs.

Eighth Embodiment

Figure 8:
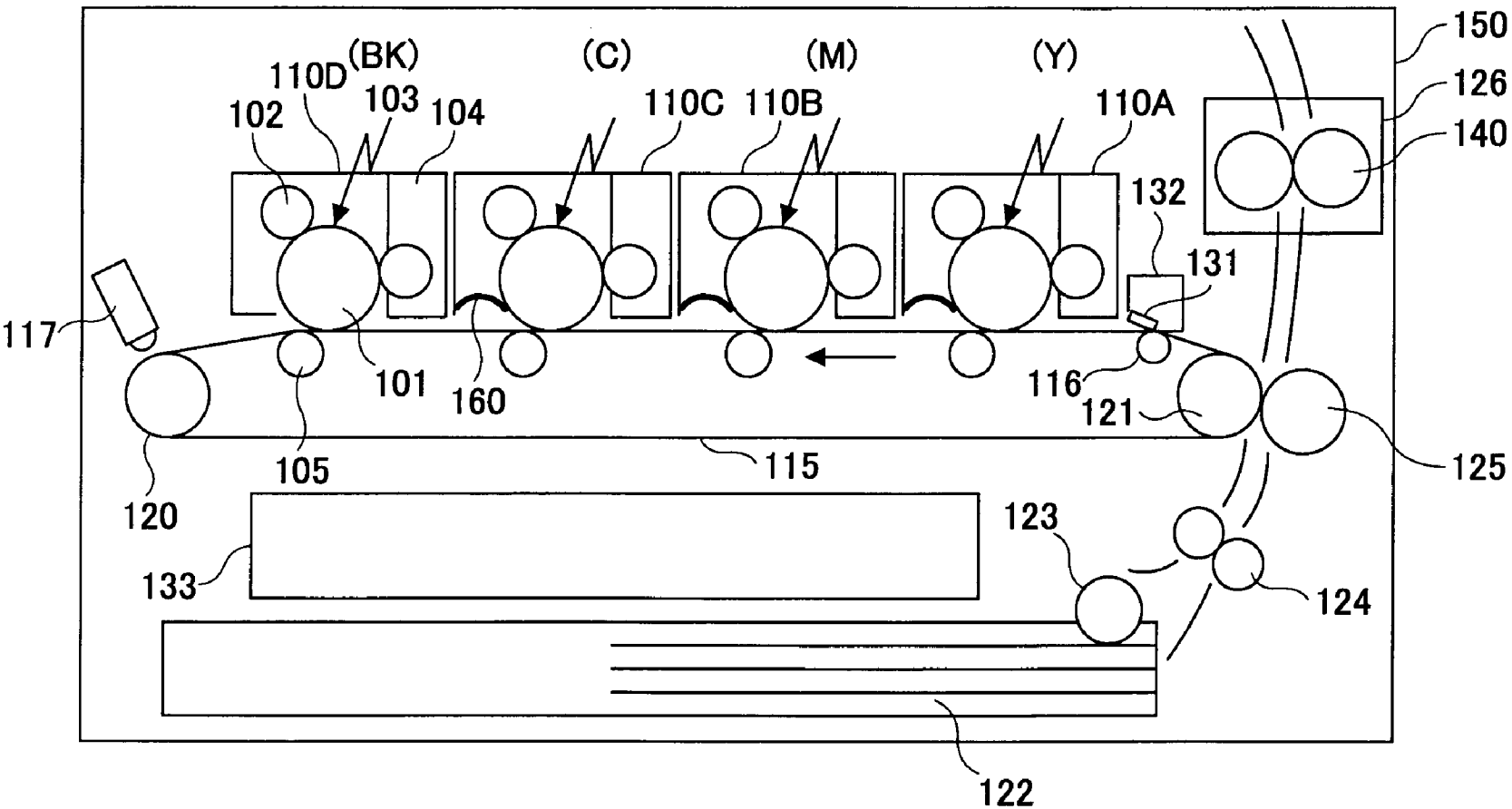
FIG. 8 is a drawing illustrating an exemplary image forming apparatus according to an eighth embodiment of the present invention.

FIG. 8 is a drawing illustrating a variation of the image forming apparatus 150 according to an eighth embodiment of the present invention. As shown in FIG. 8, the image forming apparatus 150 of the eighth embodiment has substantially the same configuration as that shown in FIG. 7 except that the sheet part 160 is not provided for the Bk process cartridge 110D that is placed in the most downstream position among the four process cartridges 110. With this configuration, the Bk process cartridge 110D reclaims post-transfer residual toner and reverse-transferred toner and puts them into the developing unit 104 of itself. More specifically, post-transfer residual toner and reverse-transferred toner passed from the process cartridges 110A through 110C to the intermediate transfer belt 115 are carried to the Bk process cartridge 110D, adhere to the photoconductive drum 101 of the Bk process cartridge 110D, carried by the rotation of the photoconductive drum 101 toward the charging unit 102 without being scraped by the sheet part 160, and then enter the developing unit 104. Even if the black toner is mixed with toner of a different color, the influence is very small. Rather, reclaiming toner by the Bk process cartridge 110D makes it possible to reduce toner consumption and has an advantage in terms of ecology. Post-transfer residual toner and reverse-transferred toner not reclaimed by the Bk process cartridge 110D are reclaimed by the intermediate transfer belt cleaning unit 132 and put into the waste toner container 133 as in the seventh embodiment.

Ninth Embodiment

Figure 9:
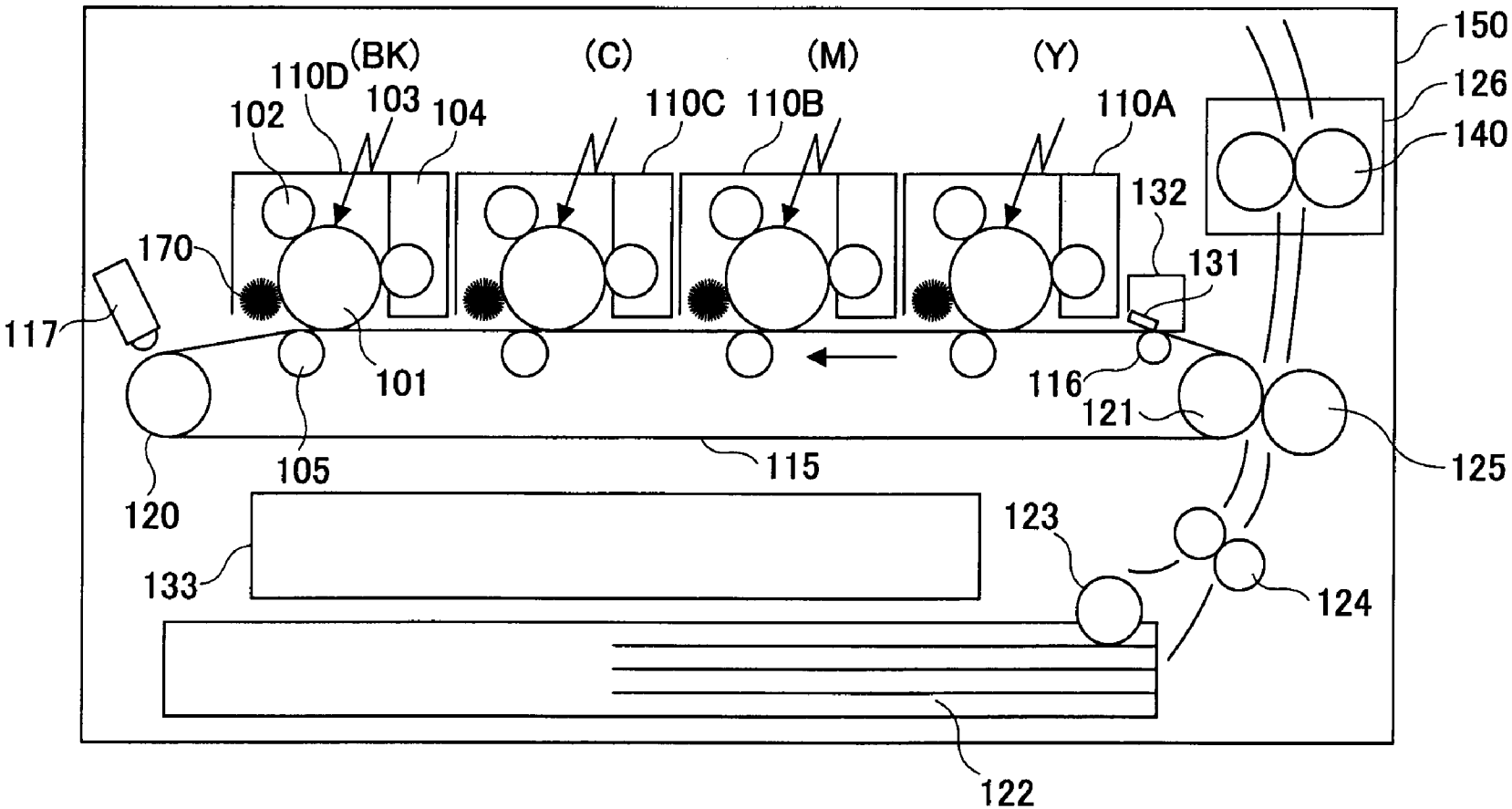
FIG. 9 is a drawing illustrating an exemplary image forming apparatus according to a ninth embodiment of the present invention.

FIG. 9 is a drawing illustrating another variation of the image forming apparatus 150 according to a ninth embodiment of the present invention. As shown in FIG. 9, the image forming apparatus 150 of the ninth embodiment includes roller brushes 170 for removing post-transfer residual toner on the photoconductive drums 101. Each of the roller brushes 170 is in contact with the photoconductive drum 101 but is not in contact with the intermediate transfer belt 115. The roller brush 170 rotates in a direction counter to the rotational direction of the photoconductive drum 101 and causes residual toner to fall onto the intermediate transfer belt 115 by gravity. Other configurations of the image forming apparatus 150 of the ninth embodiment are substantially the same as those shown in FIG. 7. The roller brush 170 is, for example, made of nylon, polyethylene terephthalate (PET), or acrylic resin. In this embodiment, acrylic resin, which is ranked lower (closer to the most negatively charged side) in the triboelectric series than polyester toner, is used to positively charge polyester toner. The roller brush 170, for example, has a diameter of 11 mm and is made by wrapping a brush sheet (fiber size: 6 denier, volume resistivity: $10^4$ Ω·cm, fiber density: 300,000/inch$^2$) around a metal roller with a diameter of 6 mm. This configuration makes it possible to implement a cleaner-less image forming apparatus configured to prevent post-transfer residual toner on a photoconductive drum from entering a developing unit and thereby to prevent a color shift that is a problem in conventional cleaner-less image forming apparatuses.

Figure 10:
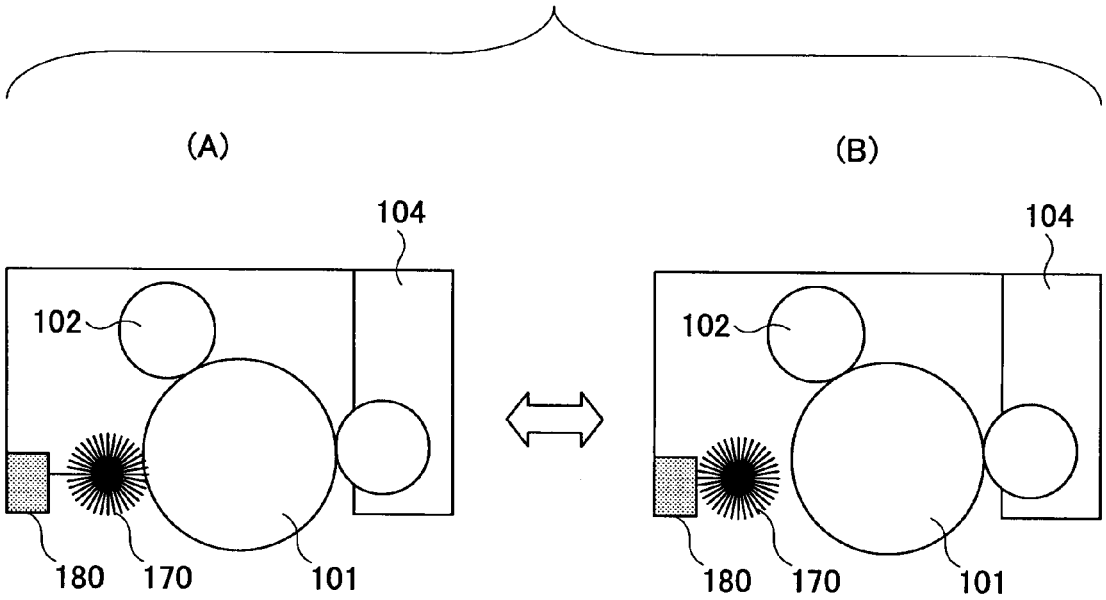
FIG. 10 is a drawing illustrating a variation of the exemplary image forming apparatus of the ninth embodiment.

FIG. 10 is a drawing illustrating a variation of the image forming apparatus 150 shown in FIG. 9. In FIG. 10, a retracting mechanism 180 is provided for the roller brush 170. If the roller brush 170 is always in contact with the photoconductive drum 101, the roller brush 170 continuously wears and degrades the photoconductive drum 101. To prevent this problem, the retracting mechanism 180 brings the roller brush 170 into contact with the photoconductive drum 101 as shown in FIG. 10 (A) when a toner image is being transferred and pulls the roller brush 170 away from the photoconductive drum 101 as shown in FIG. 10 (B) when no toner image is being transferred. This configuration makes it possible to reduce abrasion of the photoconductive drum 101.

Tenth Embodiment

Figure 11:
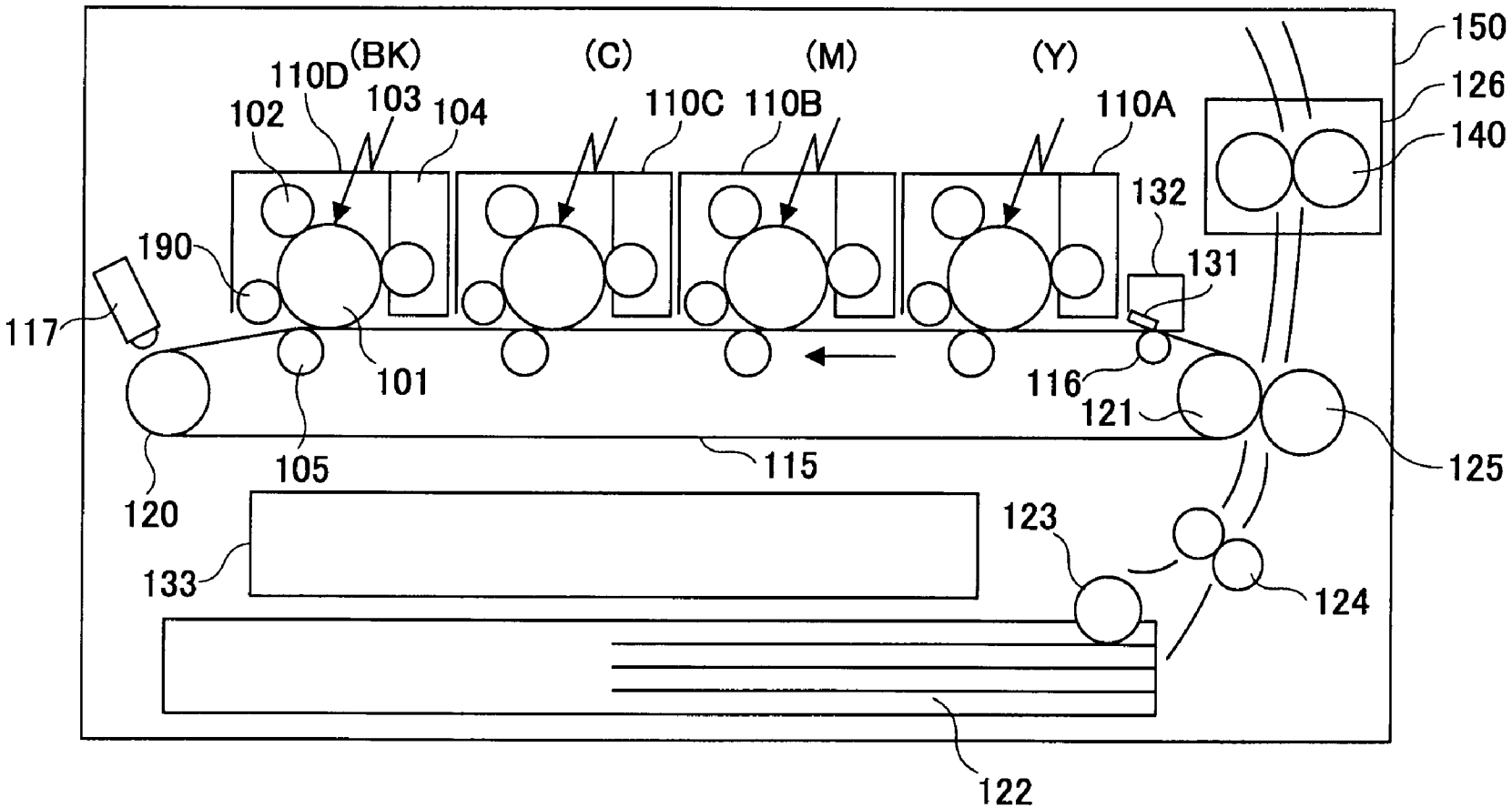
FIG. 11 is a drawing illustrating an exemplary image forming apparatus according to a tenth embodiment of the present invention.

FIG. 11 is a drawing illustrating still another variation of the image forming apparatus 150 according to a tenth embodiment of the present invention. As shown in FIG. 11, the image forming apparatus 150 of the tenth embodiment includes rollers 190 for removing post-transfer residual toner on the photoconductive drums 101. Each of the rollers 190 is in contact with the photoconductive drum 101 but is not in contact with the intermediate transfer belt 115. The roller 190 rotates in a direction counter to the rotational direction of the photoconductive drum 101 and causes residual toner to fall onto the intermediate transfer belt 115 by gravity. Other configurations of the image forming apparatus 150 of the tenth embodiment are substantially the same as those shown in FIG. 7. The roller 190 is preferably implemented by a urethane roller, a urethane-coated roller, a fluoroplastic roller, or a fluoroplastic-coated roller. Especially, a fluoroplastic, which is a highly negative material in the triboelectric series, is preferable as the material of the roller 190. This configuration makes it possible to implement a cleaner-less image forming apparatus configured to prevent post-transfer residual toner on a photoconductive drum from entering a developing unit and thereby to prevent a color shift that is a problem in conventional cleaner-less image forming apparatuses.

Types and configurations of image forming apparatuses provided by the present invention are not limited to those described in the above embodiments. Also, an image carrier other than a photoconductive drum and an intermediate transfer body other than an intermediate transfer belt may be used in an image forming apparatus according to the present invention. Further, the retracting mechanism 180 described in the ninth embodiment may also be applied to other embodiments.

Embodiments of the present invention provide an image forming apparatus and a process cartridge used in the image forming apparatus that make it possible to prevent toner of one color remaining on an image carrier after image transfer from being mixed with toner of a different color in a developing unit and causing a color shift. At the same time, embodiments of the present invention make it possible to reduce the size of an image forming apparatus and to provide an ecologically-friendly image forming apparatus that can reduce toner consumption and reduce or substantially eliminate waste toner.

Embodiments of the present invention provide an image forming apparatus including a contacting member for removing residual toner on an image carrier and passing the removed toner to an endless belt, and a toner reclaiming unit for reclaiming and storing the toner passed to the endless belt. The contacting member is in contact with the image carrier and causes the residual toner on the image carrier to fall onto the endless belt by gravity. The contacting member may be implemented by a sheet part, a roller brush, a roller, or a blade. This configuration makes it possible to prevent toner of one color in a developing unit from being mixed with reverse-transferred toner of another color. Also, this configuration eliminates the need to provide a cleaning device with a housing as disclosed in patent document 2 and requires only a contacting member for removing residual toner on an image carrier. Therefore, this configuration makes it possible to reduce the size and costs of an image forming apparatus. Using a sheet part as a contacting member makes it possible to use an inexpensive and flexible material to implement a mechanism for removing toner or charging toner to an opposite polarity. Using a roller brush as a contacting member makes it possible to increase a nip between the contacting member and an image carrier and thereby to improve the toner-removing performance of the contacting member. Using a roller as a contacting member makes it possible to disperse removed toner when passing it to an intermediate transfer body.

The present invention is not limited to the specifically disclosed embodiments, and variations and modifications may be made without departing from the scope of the present invention.

The present application is based on Japanese Priority Application No. 2006-350673 filed on Dec. 26, 2006, and Japanese Priority Application No. 2007-031448 filed on Feb. 13, 2007, the entire contents of which are hereby incorporated herein by reference.

What is claimed is:

1. An image forming apparatus, comprising:

an image carrier;

a toner image forming unit configured to form a toner image having a predetermined polarity on the image carrier;

an intermediate transfer body facing the image carrier;

a primary transfer member configured to transfer the toner image on the image carrier onto the intermediate transfer body;

a secondary transfer member configured to transfer the toner image on the intermediate transfer body onto a recording medium; and a contacting member that contacts the image carrier and is configured to remove residual toner remaining on the image carrier after the toner image is transferred by the primary transfer member onto the intermediate transfer body and to pass the removed residual toner to the intermediate transfer body, wherein a bias voltage with a same polarity as the predetermined polarity of the toner image is applied to the contacting member, and the contacting member is disposed adjacent to the intermediate transfer body around a periphery of the image carrier.

2. The image forming apparatus as claimed in claim 1, wherein the bias voltage is in a range between −300 V and −700 V.

3. The image forming apparatus as claimed in claim 1, wherein the bias voltage is applied to the contacting member before the residual toner reaches a position where the contacting member contacts the image carrier.

4. The image forming apparatus as claimed in claim 1, wherein the contacting member is a sheet part comprising nylon 6, nylon 12, vinylon, saran, rayon, polyethylene, acrylic resin, or fluoroplastic.

5. The image forming apparatus as claimed in claim 1, wherein the image carrier is rotatable in a predetermined rotational direction and the contacting member contacts the image carrier in a counter direction with respect to the rotational direction.

6. The image forming apparatus as claimed in claim 1, wherein the image forming apparatus comprises a plurality of the image carriers, a plurality of the toner image forming units, and a plurality of the primary transfer members facing the corresponding image carriers via the intermediate transfer body;

the toner image forming units are configured to form toner images of different colors on the corresponding image carriers;

the intermediate transfer body is configured to move in a predetermined moving direction;

the primary transfer members are configured to transfer the toner images of the different colors in sequence onto the intermediate transfer body and thereby to superpose the toner images on the intermediate transfer body;

the secondary transfer member is configured to transfer the superposed toner images onto the recording medium; and one of the toner image forming units is a black toner image forming unit that is placed in a most downstream position with respect to the moving direction of the intermediate transfer body and configured to reclaim the residual toner passed to the intermediate transfer body.

7. The image forming apparatus as claimed in claim 1, wherein the image carrier is rotatable in a normal direction, in which normal direction the image carrier is rotated to transfer the toner image onto the intermediate transfer body, and a reverse direction opposite to the normal direction; and the contacting member is configured to temporarily hold the removed residual toner while the bias voltage is not being applied and to pass the removed residual toner to the intermediate transfer body when the image carrier is rotated in the reverse direction and the bias voltage is applied.

8. The image forming apparatus as claimed in claim 7, wherein the image carrier is rotated in the reverse direction at such a timing that the removed residual toner falls onto a non-image area of the intermediate transfer body.

9. The image forming apparatus as claimed in claim 7, wherein the image carrier is rotated in the reverse direction before or after a control process.

10. The image forming apparatus as claimed in claim 7, wherein a timing at which the image carrier is rotated in the reverse direction is determined based on a cumulative number of rotations of the image carrier.

11. The image forming apparatus as claimed in claim 7, wherein a timing at which the image carrier is rotated in the reverse direction is determined based on a cumulative number of rotations of the intermediate transfer body.

12. The image forming apparatus as claimed in claim 7, wherein the contacting member is a sheet part and contacts the image carrier in a forward direction with respect to the normal direction.

13. The image forming apparatus as claimed in claim 7, wherein the contacting member is a sheet part having a smoothly-curved shape or a substantially smoothly-curved shape and contacts the image carrier in the middle or in substantially the middle of the curved shape in a forward direction with respect to the normal direction.

14. The image forming apparatus as claimed in claim 1, further comprising:

a toner reclaiming unit configured to reclaim and store the residual toner transferred onto the intermediate transfer body.

15. A process cartridge, comprising:

an image carrier;

a toner image forming unit configured to form a toner image having a predetermined polarity on the image carrier;

a contacting member that contacts the image carrier and is configured to remove residual toner remaining on the image carrier after the toner image is transferred onto an image receiving body; and a bias applying unit configured to apply a bias voltage with the same polarity as the predetermined polarity of the toner image to the contacting member, wherein the image carrier is rotatable in a normal direction, in which normal direction the image carrier is rotated to transfer the toner image onto the image receiving body, and a reverse direction opposite to the normal direction, the contacting member is configured to temporarily hold the removed residual toner and to pass the removed residual toner to the image receiving body when the image carrier is rotated in the reverse direction, and the bias applying unit is configured to apply the bias voltage to the contacting member while the image carrier is being rotated in the reverse direction.

16. An image forming apparatus, comprising:

an image carrier;

an endless belt;

a transfer member configured to transfer a toner image on the image carrier onto the endless belt;

a contacting member that contacts the image carrier and is configured to remove residual toner remaining on the image carrier after the toner image is transferred and to cause the removed residual toner to fall onto the endless belt by gravity, the contacting member being implemented by a sheet part, a roller brush, or a roller; and a toner reclaiming unit configured to reclaim and store the residual toner that has fallen onto the endless belt.

17. The image forming apparatus as claimed in claim 16, further comprising:

a retracting mechanism configured to pull the contacting member away from the image carrier.

18. The image forming apparatus as claimed in claim 16, wherein the contacting member comprises a material that is ranked lower in the triboelectric series than a material of toner used in the image forming apparatus.

19. The image forming apparatus as claimed in claim 16, wherein the contacting member does not contact the endless belt.

20. The image forming apparatus as claimed in claim 16, further comprising:

a developing unit configured to form the toner image on the image carrier, wherein the image carrier, the developing unit, and the contacting member are integrated as a process cartridge.

* * * * *